US006887103B2

(12) United States Patent
Montena et al.

(10) Patent No.: US 6,887,103 B2
(45) Date of Patent: May 3, 2005

(54) COMPRESSION CONNECTOR FOR COAXIAL CABLE AND METHOD OF INSTALLATION

(75) Inventors: Noah Montena, Syracuse, NY (US); Stephen Malak, Manlius, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 10/892,038

(22) Filed: Jul. 15, 2004

(65) Prior Publication Data

US 2005/0032422 A1 Feb. 10, 2005

Related U.S. Application Data

(63) Continuation of application No. 10/309,677, filed on Dec. 4, 2002, now Pat. No. 6,780,052.

(51) Int. Cl.[7] ..... H01R 9/05
(52) U.S. Cl. ..... 439/583
(58) Field of Search ..... 439/583, 578, 439/582–585

(56) References Cited

U.S. PATENT DOCUMENTS

| | | | | |
|---|---|---|---|---|
| 3,644,874 A | | 2/1972 | Hutter | |
| 3,673,547 A | | 6/1972 | Ziegler, Jr. | |
| 3,778,535 A | | 12/1973 | Forney, Jr. | |
| 4,131,332 A | | 12/1978 | Hogendobler et al. | |
| 4,377,320 A | | 3/1983 | Lathrop et al. | |
| 4,408,822 A | | 10/1983 | Nikitas | |
| 4,795,370 A | | 1/1989 | Freitag | |
| 4,990,106 A | * | 2/1991 | Szegda | 439/585 |
| 5,137,471 A | | 8/1992 | Verespej et al. | |
| 5,295,864 A | | 3/1994 | Birch et al. | |
| 5,607,325 A | * | 3/1997 | Toma | 439/578 |
| 5,667,405 A | | 9/1997 | Hooliday | |
| 5,785,554 A | | 7/1998 | Ohshiro | |
| 5,857,865 A | | 1/1999 | Shimirak et al. | |
| 5,877,452 A | | 3/1999 | McConnell | |
| 5,975,951 A | | 11/1999 | Burris et al. | |
| 5,984,723 A | | 11/1999 | Wild | |
| 5,997,350 A | | 12/1999 | Burris et al. | |
| 6,089,913 A | | 7/2000 | Holliday | |
| D436,076 S | | 1/2001 | Montena | |
| 6,210,222 B1 | * | 4/2001 | Langham et al. | 439/583 |
| 6,790,081 B2 | * | 9/2004 | Burris et al. | 439/578 |
| 6,808,415 B1 | * | 10/2004 | Montena | 439/584 |
| 6,830,479 B2 | * | 12/2004 | Holliday | 439/585 |
| 2001/0034159 A1 | | 10/2001 | Pitschi | |

* cited by examiner

*Primary Examiner*—J. F. Duverne
(74) *Attorney, Agent, or Firm*—Wall Marjama & Bilinski LLP

(57) ABSTRACT

An F connector for mounting to the prepared end of a coaxial cable by compression of portions of the connector into tight frictional engagement with the cable. The body and compression ring of the usual F connector are incorporated in a unitary, one-piece body having three axial sections. The first section surrounds and frictionally engages the outer surface of the post stem in the usual manner. The second section is spaced from the stem to provide an annular space for the shielding and outer dielectric layers of the cable, also in the usual manner. A third section of the body is joined to the second section by an area of reduced thickness. In a first disclosed embodiment, the body fractures at the area of reduced thickness in response to an axial force applied to the third section in the direction of the second section. The wall thickness of the third section tapers outwardly from the area of reduced thickness, whereby movement of the third section between the inner surface of the second section and the outer surface of the cable by the axial force subsequent to fracture applies a radially compressive force to the cable and provides the desired tight frictional engagement of the connector and cable. In a second embodiment, the third section includes two, axially spaced area of reduced thickness. The portions of the third section adjacent these reduced thickness areas are folded into the area between the second section and the cable as the axial force is applied, rather than being fractured.

11 Claims, 6 Drawing Sheets

COMPRESSION CONNECTOR FOR COAXIAL CABLE AND METHOD OF INSTALLATION

This a continuation of U.S. patent application Ser. No. 10/309,677, filed Dec. 4, 2002, now U.S. Pat. No. 6,780,052.

BACKGROUND OF THE INVENTION

The present invention relates to connectors for installation on a terminal end of a coaxial cable as used, for example, in CATV applications by radial compression of the cable by a deformable body portion of the connector. More specifically, the invention relates to compression-type connectors wherein the number of parts is reduced and manner of effecting compression of different from conventional, prior art connectors of this type.

A common type of connector installed on a terminal end of a coaxial cable includes elements known as a post, a nut, a body and a compression ring. The post includes a hollow stem integrally joined at one end to a flange. The nut is rotatably secured to the post, typically at or near the junction of the stem and flange, and the body surrounds the stem with a first portion, near the nut, in frictional engagement therewith and a second portion in outwardly spaced relation thereto. The compression ring, a hollow, substantially cylindrical member, is initially maintained in engagement with the body by one end of the ring encircling the end of the body remote from the nut. The end of the coaxial cable is prepared by stripping away certain layers thereof at specified distances from the end of the central conductor. After the cable is "prepped" the connector is installed by inserting the cable axially into the connector with the stem of the connector post being forced between the outer layer of conducting material and the woven mesh metallic shielding layer. The shielding layer and the outer dielectric layer are in the initially open, annular space between the stem and inner surface of the body. Installation is completed by axial movement of the compression ring over the body with tapered surfaces on one or both of these members causing radial compression of the body into tight, frictional engagement with the outer surface of the coaxial cable.

The prior art includes, of course, a wide variety of styles and configurations of compression connectors of this general type. A feature common to radial compression connectors, however, is the separate fabrication of the body and compression ring which provide the means of frictionally engaging the connector with the cable. A variation of this design is disclosed in U.S. Pat. No. 5,525,076 of Down wherein the connector body includes one or more grooves extending into and around its outer surface. As the body is axially compressed, a portion of the body wall at the groove(s) is forced radially inwardly, into the outer dielectric layer of the coaxial cable. This forms a moisture barrier around the surface of the cable and mechanically locks the connector and cable, but does not radially compress the body into tight frictional engagement with the cable in the manner of the prior art connectors alluded to above and the present invention.

It is a principle object of the present invention to provide a novel and improved coaxial cable connector of the radial compression type which requires fewer parts than typical prior art connectors of the same general type, thereby offering advantages normally associated with a reduction in part count of multi-element devices.

It is a further object to provide a connector which is mounted to an end portion of a coaxial cable by a novel method of operation.

It is another object to provide novel and improved means for mounting a connector to the end of a coaxial cable.

Other objects will in part be obvious and will in part appear hereinafter.

SUMMARY OF THE INVENTION

In furtherance of the foregoing objects, the invention contemplates a connector having an essentially conventional post and nut in combination with a novel body. The post has the usual, integral flange and stem portions and the nut is rotatably engaged with the post at the flanged end. The hollow body includes a first portion extending axially from a first end and having an inner diameter substantially corresponding to the outer diameter of the post stem, a second portion extending axially from the first portion and having a larger inner diameter, and a third portion extending axially from the second portion to a second end. The three portions are integrally formed as a single, molded part. In a first disclosed embodiment, the third portion is connected to the second portion by a wall section of reduced thickness. The third portion is of the same inner diameter as the second portion and tapers to a larger outer diameter from the position of smallest wall thickness toward the second end of the body. When the connector is installed on the cable, the stem extends between the metal shielding layer of the cable and the outer conducting layer in the usual manner with these two layers positioned in the space between the outside of the stem and inside of the second body portion. When an axial force is applied (by an appropriate tool) to the third body portion, tending to move it in the direction of the first portion, the wall fractures at the section of smallest thickness, allowing the third section to be forced between the second section and the outer surface of the coaxial cable. The tapered surface on the third section is wedged between the second section and the cable surface, thereby radially compressing the cable and causing tight frictional engagement of the connector and cable.

In a second embodiment, the third section of the body has two annular areas of reduced cross section, axially spaced from one another. The thickness of these sections is such, relative to the type and characteristics of the material from which the body is fabricated, that as axial force is applied to the third section, tending to move it in the direction of the second section, that the wall folds at both areas of reduced cross section. Thus, rather than fracturing the body wall, as in the first embodiment, the body remains in a single part, but with folded layers of the third body portion between the inner surface of the second body portion and the outer surface of the cable, producing tight frictional engagement of the connector and the cable.

The features of the invention generally described above will be more readily apparent and fully appreciated from the following detailed description, taken in conjunction with the accompanying drawings.

DETAILED DESCRIPTION

Figure 1:
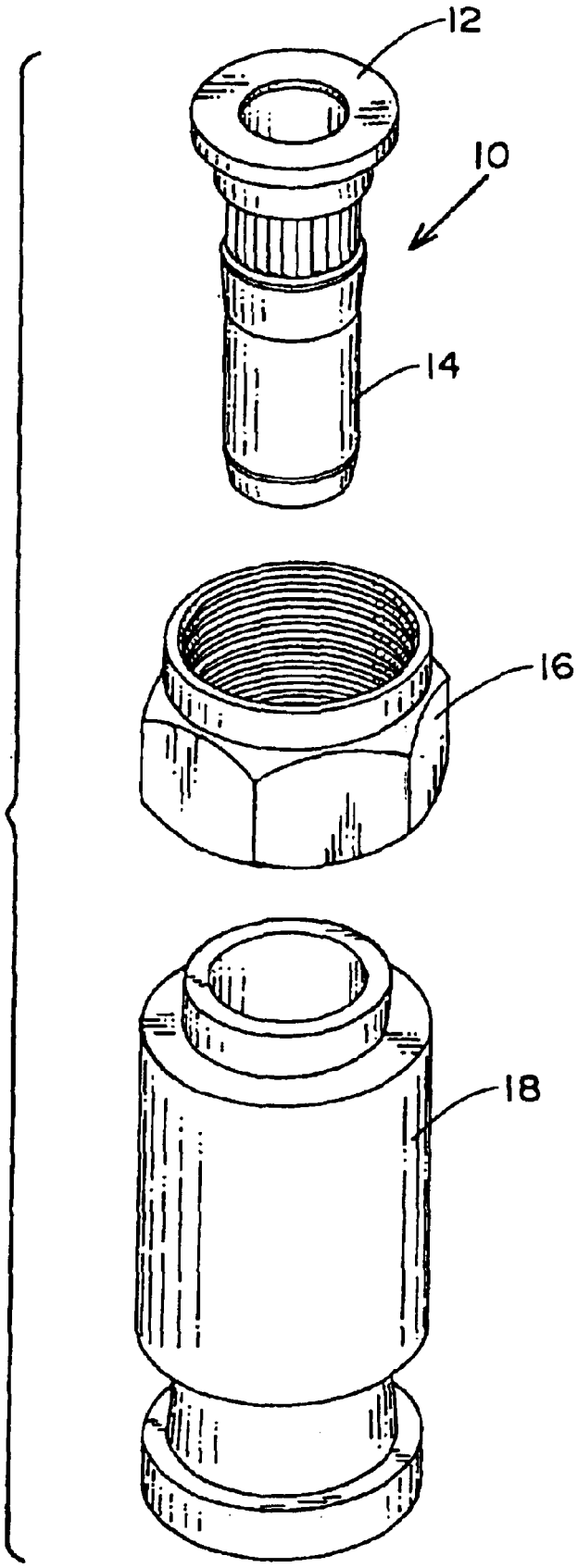
FIG. 1 is an exploded, perspective view of the cable connector of the invention, shown in a first embodiment.
Figure 2:
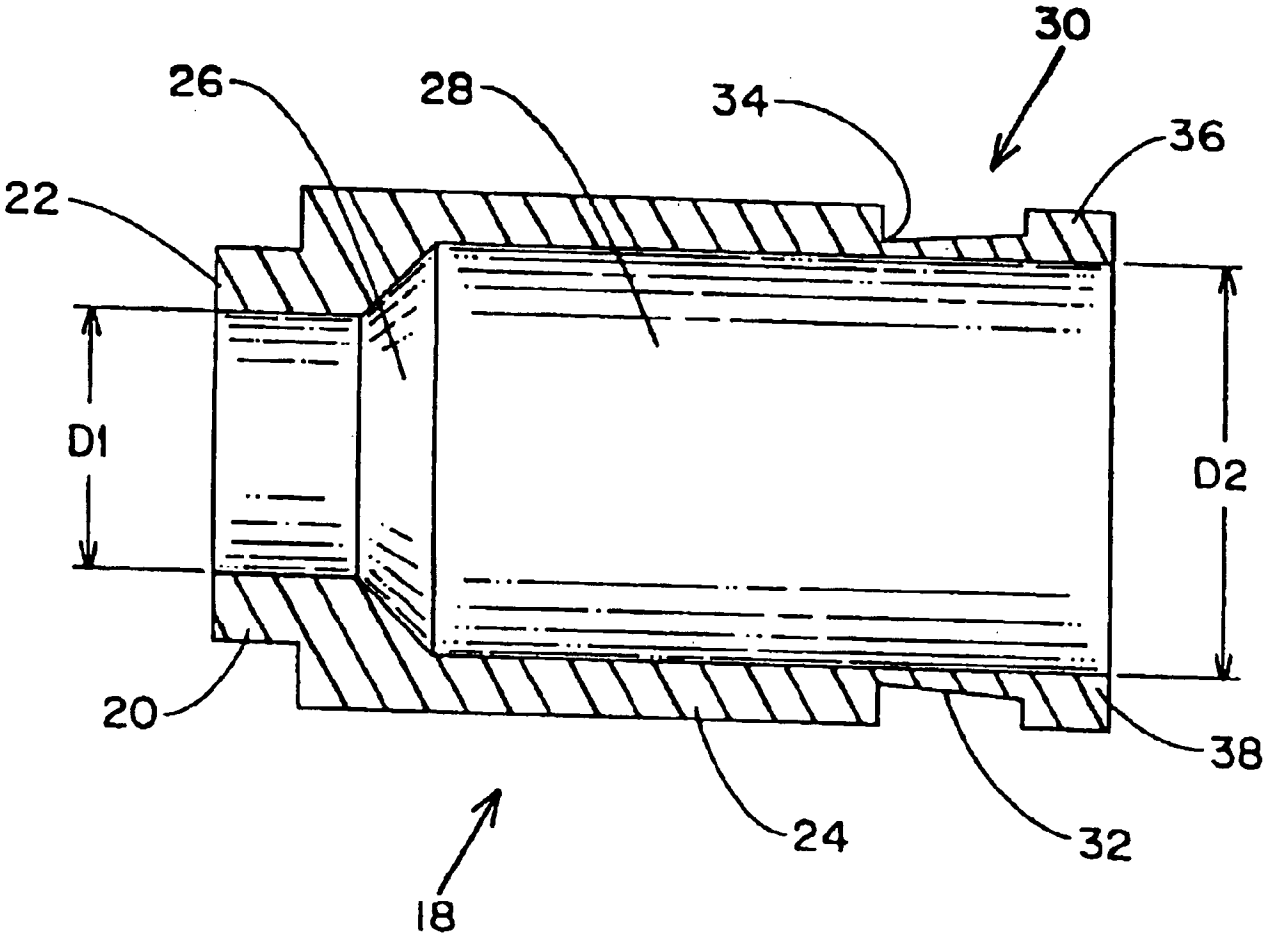
FIG. 2 is a front elevational view of one of the elements of FIG. 1 in full section.

Referring now to the drawings, in FIG. 1 are shown in three components of the connector, namely, post 10, including intergrally formed flange 12 and stem 14 sections, nut 16 and body 18. Post 10 and nut 16 are of conventional construction for use in this type of coaxial cable connector, body 18 being of unique construction, shown in a first embodiment of FIGS. 1–3. Body 18 is shown in cross section in FIG. 2 where it will be noted that the body includes three sections, integrally formed as a single piece. The first section 20 extends axially from one end 22 of body 18 for a portion of its axial length having inner diameter D1. Second section 24 includes tapered portion 26, connecting inner diameter D1 with larger inner diameter D2 of constant diameter portion 28 second section 24. Third section 30 extends integrally from second section 24 with the same inner diameter, but with a wall portion 32 of reduced thickness. The smallest thickness of wall portion 32 is at its juncture with second section 24, denoted by reference numeral 34, from which the outer surface of third section 30 tapers outwardly at a relatively small angle to wall portion 36 which has the same outer diameter as second section 24 and extends to the other end 38 of body 18. The three parts of the connector are mutually assembled by passing stem 14 through the opening defined by internal flange 17 (see FIG. 3) of nut 16, followed by passing the stem through first section 20 of body 18 until end 22 abuts larger diameter portion 15 of stem 14. Flange 17 is thus axially engaged between flange 12 of post 10 and end 22 of body 18 with nut 16 being freely rotatable with respect to post 10 and body 18.

Figure 3:
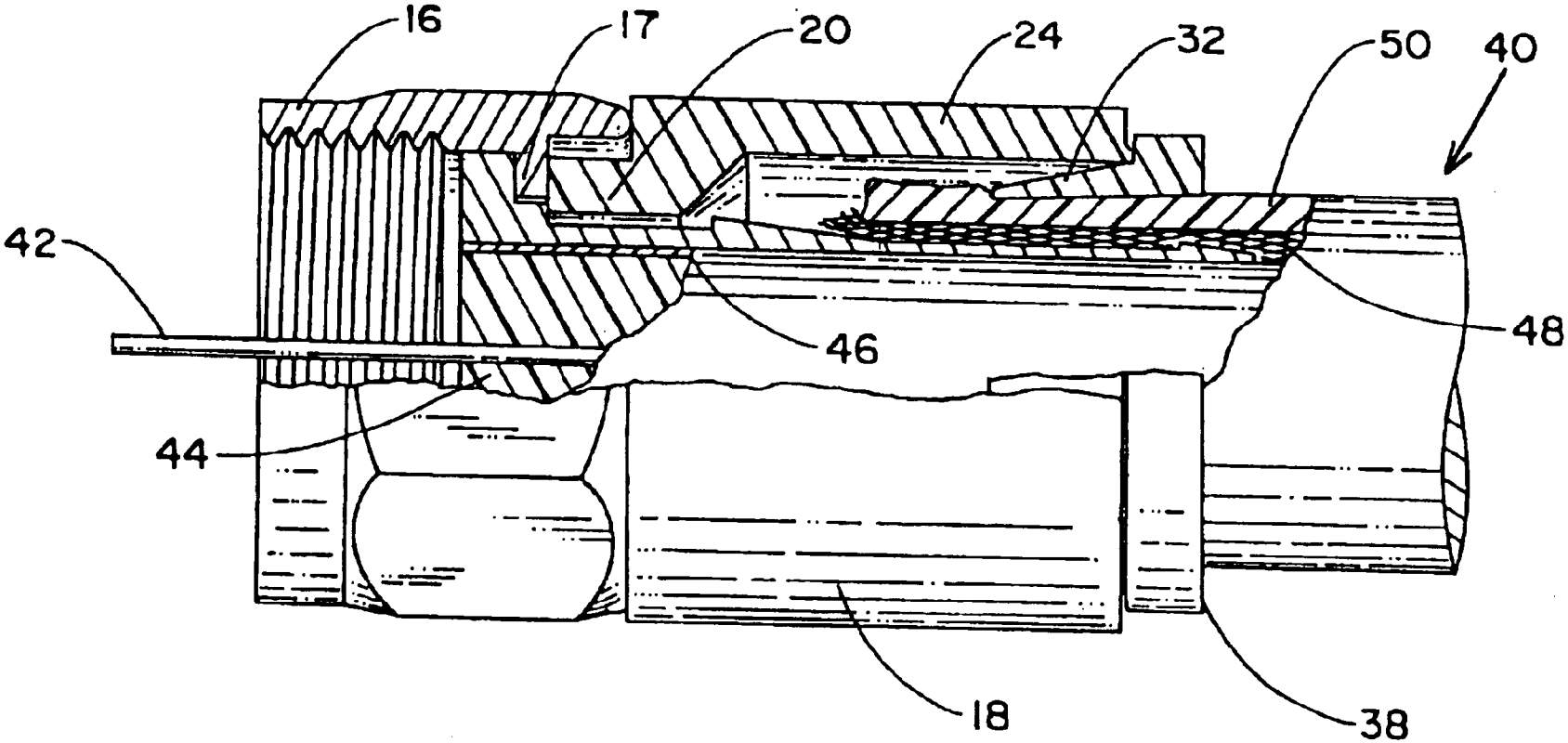
FIG. 3 is a front elevational view of the connector of FIG. 1 mounted to a conventional coaxial cable with portions of both the connector and cable broken away to be seen in section.

The connector is shown in FIG. 3 in assembled relation with an end portion of a conventional coaxial cable, denoted generally by reference numeral 40 and having inner conductor 42 surrounded by inner layer 44 of dielectric material, layer 46 of conducting material, shielding layer 48 in woven mesh form, and outer layer 50 of dielectric material. After the end of the cable has been prepped in the specified (conventional) manner, it is inserted axially into end 38 of body 18 and advanced until the exposed end surfaces of layers 44 and 46 are substantially flush with the end surface of flange 12. During this relative movement of the cable and connector, stem 14 is forcibly inserted between cable layers 46 and 48, as is also conventional in the mounting of F connectors upon coaxial cables. The connector is then engaged by a compression tool (not shown) in order to apply an axial force tending to move second and third section 24 and 30 in opposite direction, i.e., toward one another. Upon application of sufficient force in this manner, body 18 fractures about its periphery at the smallest thickness of wall section 32, i.e., at the juncture of second and third sections 24 and 30, respectively, denoted in FIG. 2 by reference numeral 34. After fracturing, body 18 is in two pieces and continued application of axial force moves wall portion 32 between the inner surface of second section 24 and the outer surface of cable dielectric layer 50. The outward taper of the outer surface of wall portion 32 results in radial compression of cable 40 and tight frictional engagement of the connector and cable, as shown in FIG. 3.

Figure 4:
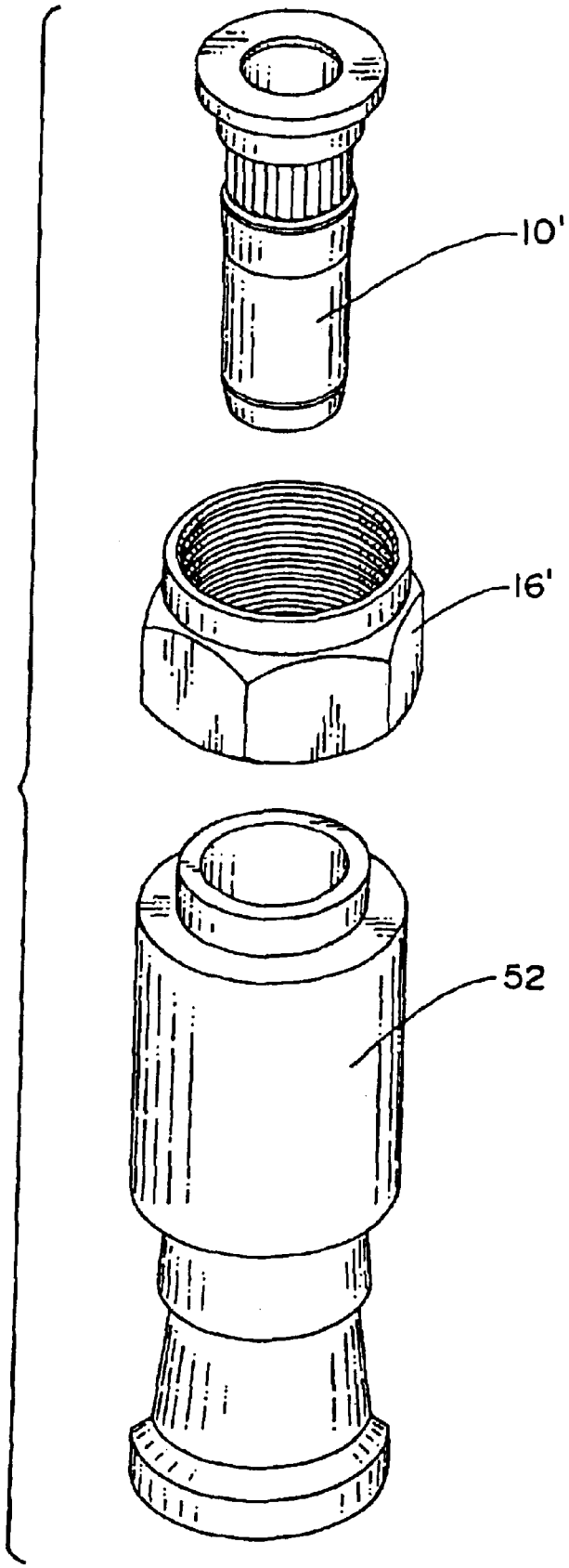
FIG. 4 is an exploded, perspective view of the cable connector of the invention, shown in a second embodiment.
Figure 5:
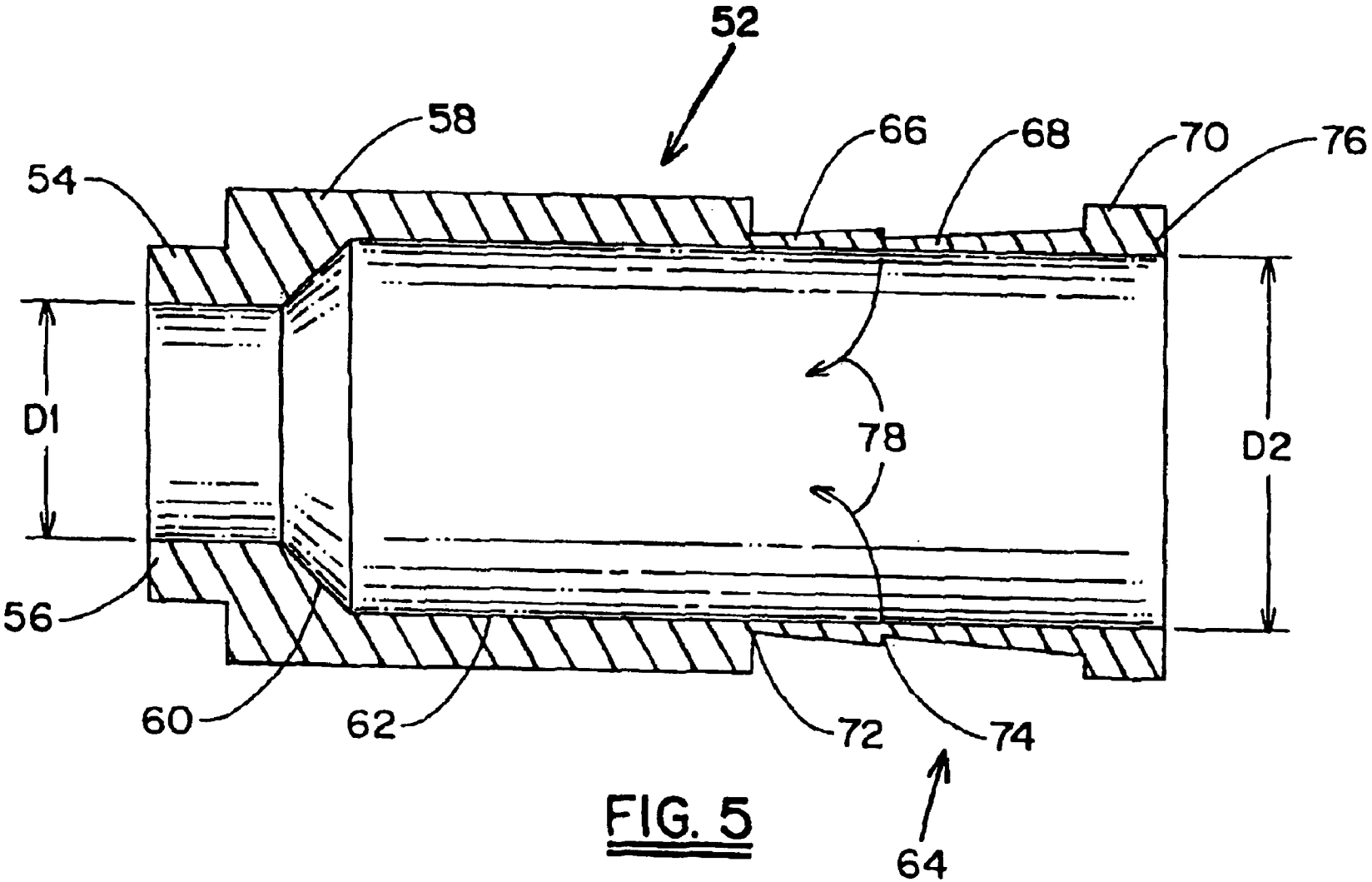
FIG. 5 is a front elevational view of one of the elements of FIG. 4 in full section.
Figure 6:
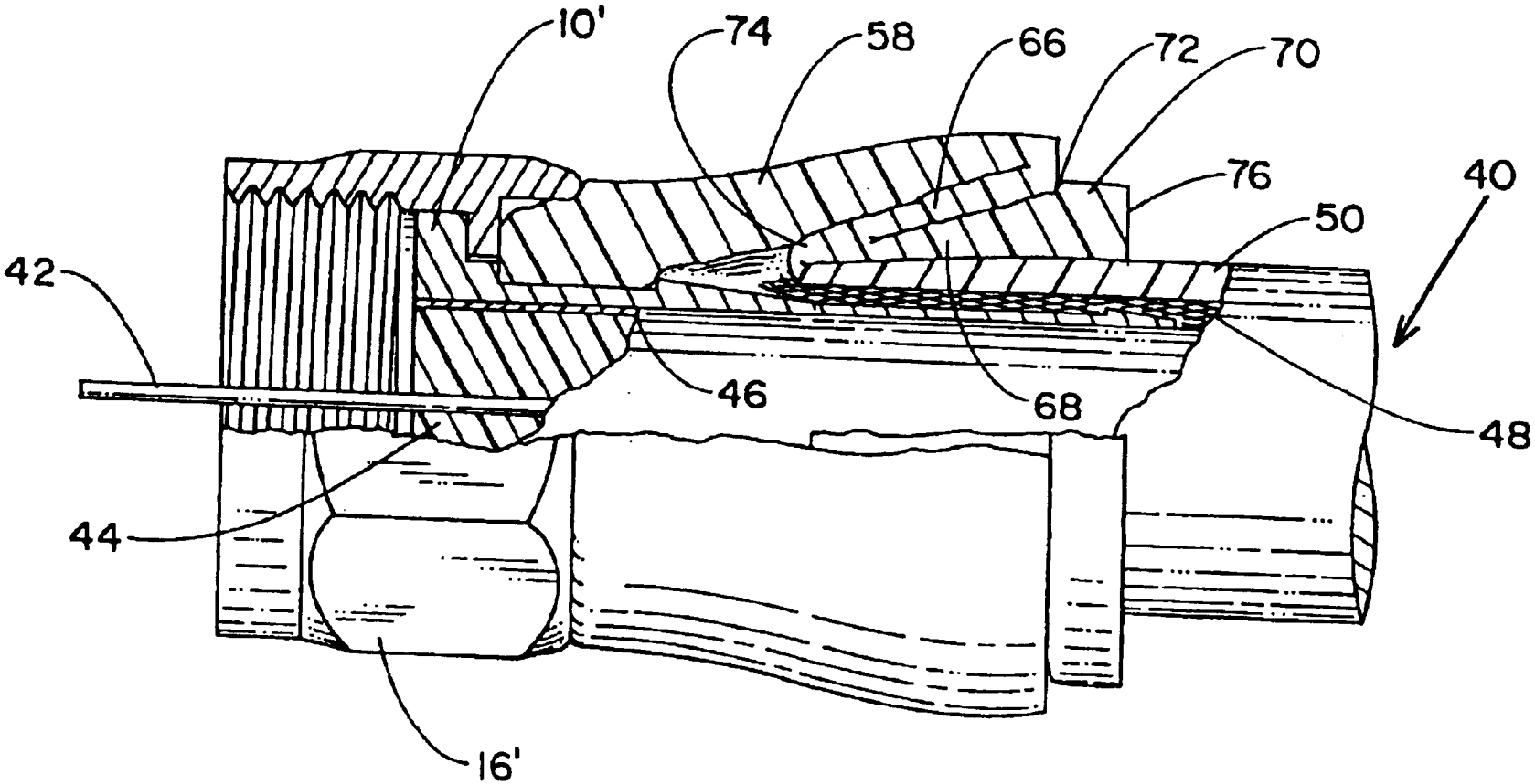
FIG. 6 is a front elevational view of the connector of FIG. 4 mounted to a conventional coaxial cable with portions of both the connector and cable broken away to be seen in section.

Turning now to FIGS. 4–6, the connector is shown with a second embodiment of body, denoted by reference numeral 52, in combination with the conventional post and nut, here denoted by numerals 10' and 16', respectively. Body 52, as best seen in the sectional view of FIG. 5, again includes first section 54, extending from one end 56 of the body for the axial length thereof having inner diameter D1, second section 58, having tapered inner surface portion 60 connecting diameter D1 with larger inner diameter D2 of constant diameter portion 62 of second section 58. In this embodiment, third section 64 includes first, second and third wall portions 66, 68 and 70, respectively. First portion 66 extends from the junction of second and third sections 58 and 64, respectively, at a first area 72 of reduced thickness, tapering outwardly to its juncture with second portion 68 at a second area 74 of reduced thickness. Second portion 68 tapers outwardly to its junction with third portion 70 which extends to the other end 76 of body 52. Third section 64 is of constant inner diameter D2 throughout its length and is of smaller outer diameter over both portions 66 and 68 than second section 58, the outer diameter of third wall portion 70 being equal to that of second section 58.

Body 52 differs from body 18 not only in the use of an additional wall portion in the third section, but also in the material used and the manner of operation. Body 18 is preferably of a quite rigid plastic which also exhibits a degree of brittleness, whereby the material fractures at the peripheral line of smallest thickness and axial movement of the tapered portion between the second body portion and the cable radially compresses the cable with little if any outward radial movement of the body. Body 52, on the other hand, is made of a more flexible, elastic material. When axial force is applied with a compression tool, rather than fracturing, first wall portion 66 folds inwardly about the periphery of reduced thickness area 72, causing the periphery at reduced thickness area 74 to move in the direction of arrows 78. After movement of portion 66 substantially 180*o,* into contact with the inner surface of second section 58, wall section 68 has moved into surface-to-surface contact with wall section 66, as shown in FIG. 6 which also includes the coaxial cable with common reference numerals denoting the same parts thereof as in FIG. 3. The axial force producing the folding action of wall portions 66 and 68 is applied, of course, after the cable has bee inserted into the connector. Consequently, the outer surface of the cable stands in the way of the inner movement of wall section 66, as indicated by arrows 78 in FIG. 5. The flexible nature of body 52 permits outward, flexing movement of second section 58 as inward movement of section 66 begins and inward contraction thereof as the folding is completed. The combined thickness of wall sections 66 and 68 The thickness in areas 72 and 74 are established as a function of the properties of the material of body 52 to provide the desired folding action upon application of axial force tending to move third section 64 toward second section 58.

What is claimed is:

1. A compression connector for mounting upon the end of a coaxial cable that has a center conductor, an inner layer of dielectric material, a woven mesh of shielding material surrounding the dielectric layer and an outer protective jacket, wherein said connector includes:

a hollow one piece body having a weakened end section that is integrally joined to a main body section such that the weakened end section of the body can be telescoped inside the main body section when an axial force is applied to the body;

a hollow post mounted inside the body, said post having a cross section such that the post is able to pass between the dielectric layer and the woven mesh shield of a coaxial cable that is inserted into the body through said weakened end section of the body; and said post co-acting with the telescoped weakened end section of the body to radially compress said cable in tight frictional engagement between the post and the telescoped weakened end section of the body when an axial force is applied to said body that is sufficient to telescope the weakened end section inside said body.

2. The compressive connector of claim 1 wherein said weakened end section is fabricated of a material that permits the weakened end section to break away from the body as the end section is telescoped inside the body.

3. The compression connector of claim 1 wherein said weakened end section is fabricated of a material that permits the weakened section to fold under the body as the end section is telescoped inside the body.

4. The compression connector of claim 1 wherein said hollow post protrudes outwardly from said body through a second end of said body.

5. The compression connector of claim 4 that further includes a threaded nut rotably secured to the outwardly protruded section of the post.

6. The compression connection of claim 1 wherein said weakened end section of said body tapers downwardly toward said second end of said body.

7. The compression connection of claim 1 wherein said post includes a cylindrical stem that is contained within said body and a flange mounted upon the end of the outwardly protruding section for rotatably engaging said nut.

8. A method of mounting a connector to a prepared end of a coaxial cable having a center conductor, an inner layer of dielectric material, a woven mesh shield surrounding the dielectric layer and an outer protective jacket, said method including the step of:

providing a hollow body that has a weakened end section that is integrally joined to a main body section such that the weakened end section of the body will telescope inside the main body section when an axial force is applied to the body, mounting a hollow post inside the body so that the post is axially aligned with the body;

inserting a prepared end of a coaxial cable into said weakened end section of the body so that the post passes between the dielectric layer and the woven mesh shield of the cable; and applying a sufficient axial force to the body so that the weakened end section of said body telescopes inside said main body section to radially compress said coaxial cable in tight frictional engagement between the post and the telescoped end section.

9. The method of claim 8 that includes the further step of extending said post through a second opposite end of the body so that the post protrudes beyond said second end of the body and rotatably mounting a threaded nut upon the protruded end of the post.

10. The method of claim 8 that includes the further step of fabricating the weakened end section of a material such that the end section breaks away from the body as the section is telescoped inside the body.

11. The method of claim 8 that includes the further step of fabricating the weakened section of a material such that the end section folds inside the body as the end section is telescoped inside the body.

* * * * *